US007665583B2

(12) United States Patent
Kuipers

(10) Patent No.: US 7,665,583 B2
(45) Date of Patent: Feb. 23, 2010

(54) ELEVATOR INSTALLATION AND USE OF SUCH ELEVATOR INSTALLATION FOR HIGH-SPEED ELEVATORS

(75) Inventor: Erwin Kuipers, Cham (CH)

(73) Assignee: Inventio AG, Hergiswil NW (CH)

( * ) Notice: Subject to any disclaimer, the term of this patent is extended or adjusted under 35 U.S.C. 154(b) by 107 days.

(21) Appl. No.: 11/760,157

(22) Filed: Jun. 8, 2007

(65) Prior Publication Data

US 2008/0000728 A1 Jan. 3, 2008

(30) Foreign Application Priority Data

Jun. 9, 2006 (EP) ..... 06115221

(51) Int. Cl.
*B66B 7/00* (2006.01)
*B66B 7/02* (2006.01)
*B66B 9/00* (2006.01)

(52) U.S. Cl. ..... 187/414; 187/406; 187/404; 52/30

(58) Field of Classification Search ..... 52/30, 52/169.13, 632; 187/404, 406, 414
See application file for complete search history.

(56) References Cited

U.S. PATENT DOCUMENTS

| | | | |
|---|---|---|---|
| 3,945,468 A | 3/1976 | Miura et al. | |
| 5,018,602 A | 5/1991 | Salmon et al. | |

FOREIGN PATENT DOCUMENTS

| | | | |
|---|---|---|---|
| GB | 1 481 619 A | | 8/1977 |
| GB | 1 481 619 A | | 8/1987 |
| GB | 2 242 664 A | | 10/1991 |
| JP | 48 087541 A | | 11/1973 |
| JP | 04341479 A | * | 11/1992 |
| JP | 09 328267 A | | 12/1997 |
| JP | 10007341 A | * | 1/1998 |
| JP | 2002 003090 A | | 1/2002 |
| JP | 2002003090 A | | 1/2002 |
| JP | 2002 338167 A | | 11/2002 |
| JP | 2002-338167 A | | 11/2002 |
| JP | 2004-359396 A | | 12/2004 |
| JP | 2005 053635 A | | 3/2005 |
| JP | 2006036450 A | * | 2/2006 |
| JP | 2006 124142 A | | 5/2006 |

* cited by examiner

*Primary Examiner*—John Q. Nguyen
*Assistant Examiner*—Stefan Kruer
(74) *Attorney, Agent, or Firm*—Fraser Clemens Martin & Miller LLC; William J. Clemens

(57) ABSTRACT

An elevator installation with an elevator shaft and an elevator car which is connected with a counterweight such that on movement of the elevator car the counterweight executes an opposite movement and the elevator car moves past the counterweight in a proximity region in the elevator shaft. Provided in the proximity region is an enlargement of the cross-section of the elevator shaft so as to reduce a pressure shock which builds up in the proximity region when the elevator car moves past the counterweight. Noise and vibrations can thereby be prevented.

9 Claims, 3 Drawing Sheets

ELEVATOR INSTALLATION AND USE OF SUCH ELEVATOR INSTALLATION FOR HIGH-SPEED ELEVATORS

FIELD OF THE INVENTION

The invention relates to an elevator installation with an elevator shaft, a counterweight and an elevator car wherein the elevator car moves past the counterweight in the elevator shaft, and in particular to a high-speed elevator installation of this type.

BACKGROUND OF THE INVENTION

In elevator installations having an elevator car connected with a counterweight by way of support means the counterweight moves in opposite direction to the elevator car. The elevator car and the counterweight are in that case respectively guided in their own substantially rectilinear guide tracks. A pressure shock in the elevator shaft, which can cause vibrations and noise, can occur when the counterweight passes the elevator car particularly in single elevator shafts and with fast-moving elevator cars. Moreover, the sudden pressure change, which is connected therewith, in the elevator car can be unpleasant for the passengers or the vibrations can be sensed as disturbing. The elevator installation then has deficient travel comfort. Disruptive noises can also arise in buildings in which the elevator installation is located.

These problems occur particularly with present-day elevator installations, since there is increasing effort to reduce the enclosed space as much as possible and to accommodate components of the elevator installation in the smallest possible space.

This problem of crossing of the counterweight and the elevator car in the elevator shaft has been known for a long time. However, previously only one solution of interest to deal with disadvantages arising during crossing of two elevator cars was offered. This solution is of recent date and is evident from the Japanese patent application of the company Toshiba Corp., with the publication number 2002003090 A. This patent application is concerned with elevator installations in multiple elevator shafts with several elevator cars which move past one another. It is proposed to reduce the speed of the cars, before meeting in the elevator shaft, by means of a control so as to prevent creation of noises and vibrations. Passengers can, however, perceive this reduction in speed as unpleasant. In addition, the conveying capacity of the overall installation is reduced, because a longer travel time results due to the reduction in speed.

In addition, there are numerous solutions concerned with improvement of aerodynamics, i.e. the air resistance, of elevator cars, but intrinsically say nothing about the problem of pressure shock and possible solutions.

SUMMARY OF THE INVENTION

The object therefore arises of providing an elevator installation which on the one hand reduces the problems arising due to the pressure shock when the counterweight and the elevator car pass and correspondingly improves travel comfort and on the other hand does not create excessive mechanical or control complication.

Moreover, solutions are to be offered which enable good space utilization of the building and are particularly suitable for use in high-speed elevators.

According to the present invention these objects are fulfilled by provision of a specially designed elevator shaft having a local cross-sectional enlargement in the region where the elevator car and the oppositely running counterweight meet in the elevator shaft. Due to such a local cross-sectional enlargement the pressure shock, which appears to be the principal cause for vibrations and noises, can be significantly reduced without the space enclosed by the elevator shaft having to be significantly increased.

Movement of the counterweight past the elevator car can take place almost free of vibration and noise through a corresponding constructional measure in creation of the elevator shaft.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
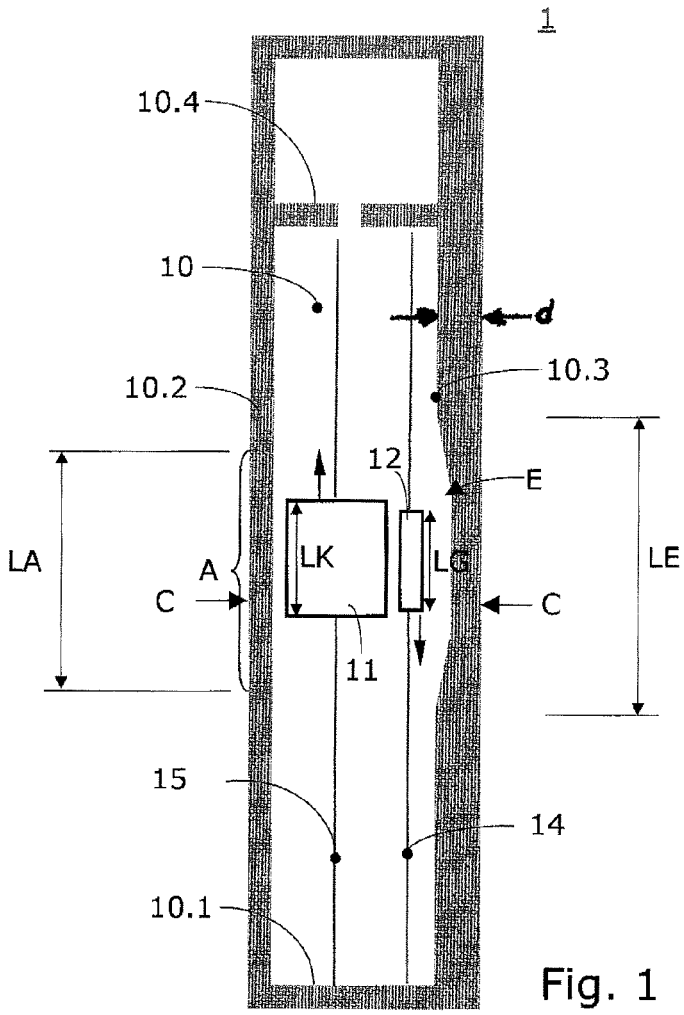
FIG. 1 is a schematic diagram of a first elevator installation according to the present invention from the side.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Components which are the same and function similarly or identically are provided in all figures with the same reference numerals.

FIG. 1 shows an elevator installation 1. The elevator installation 1 comprises an elevator shaft 10 which in the illustrated example is bounded by a floor 10.1, side walls 10.2, 10.3 and a (intermediate) roof 10.4. Disposed in the elevator shaft 10 is at least one elevator car 11 and counterweight 12, which are arranged to be movable along vertical rectilinear guide tracks 14, 15. The elevator car 11 and the counterweight 12 are so connected by way of a support means (not illustrated) that during movement of the elevator car 11 the counterweight 12 executes an opposite movement, as indicated by the arrows above the elevator car 11 and below the counterweight 12. At the illustrated instant the elevator car 11 moves upwardly and the counterweight 12 downwardly. A single car is shown in the example according to FIG. 1. A multi-deck car, for example a double-deck car, could obviously also be used. In the case of a multi-deck car several cars are arranged one behind the other and move as a coherent car transport unit in the elevator shaft.

The elevator car 11 and the counterweight 12 move past one another in a proximity region A. The length LA of this proximity region A (schematically indicated in FIG. 1 by a bracket) depends on the length of the elevator car LK and the length of the counterweight LG. The length LA of the proximity region A can be determined according to the following formula:

$$LA = LK + LG + \frac{|LK - LG|}{2}$$

If the counterweight LG and the car LK are of the same length, the length LA of the proximity region A is thus:

$$LA=2*LK \text{ or } 2*LG$$

The proximity region A is located at that place of the elevator shaft 10 where elevator car 11 and counterweight 12 meet. In the case of a multi-deck car the length LK contains the length of the entire car transport unit.

According to the present invention an enlargement E of the cross-section Q of the elevator shaft 10 is provided in the proximity region A in order to reduce the pressure shock which builds up in the proximity region A when the elevator car 11 moves past the counterweight 12.

Figure 2:
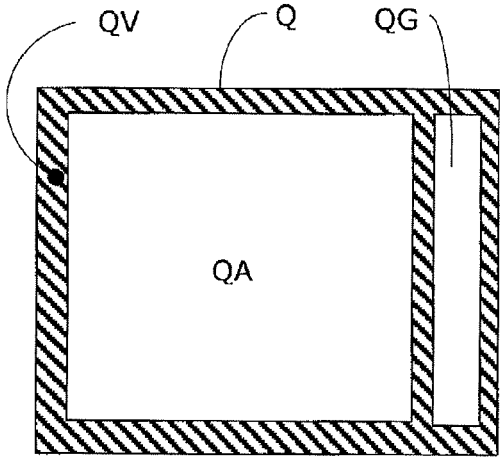
Fig. 2 (PRIOR ART)
FIG. 2 is a schematic section through a conventional elevator shaft with an elevator car and a counterweight.

The mentioned pressure shock arises due to the fact that the movement of the counterweight past the elevator car produces a transient change in the flow resistance of the car, since the air flow near the elevator car is influenced. The counterweight 12 already influences the air flow shortly prior to passing of the counterweight 12 and elevator car 11 and the air can hardly flow past the car 11 in the remaining shaft cross-section QV=Q−(QA+QG) of a conventional elevator shaft. In the stated formula QA is the cross-section of the elevator car 11 and QG the cross-section of the counterweight 12. This situation is schematically illustrated in FIG. 2 in a section through a conventional elevator shaft. The remaining shaft cross-section QV is hatched in this illustration.

Figure 3A:
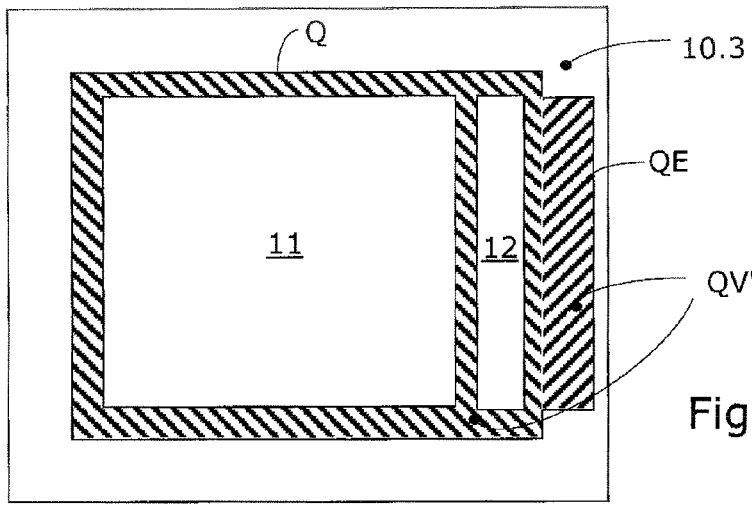
FIG. 3A is a schematic section through the elevator shaft of the first elevator installation shown in FIG. 1.
Figure 3B:
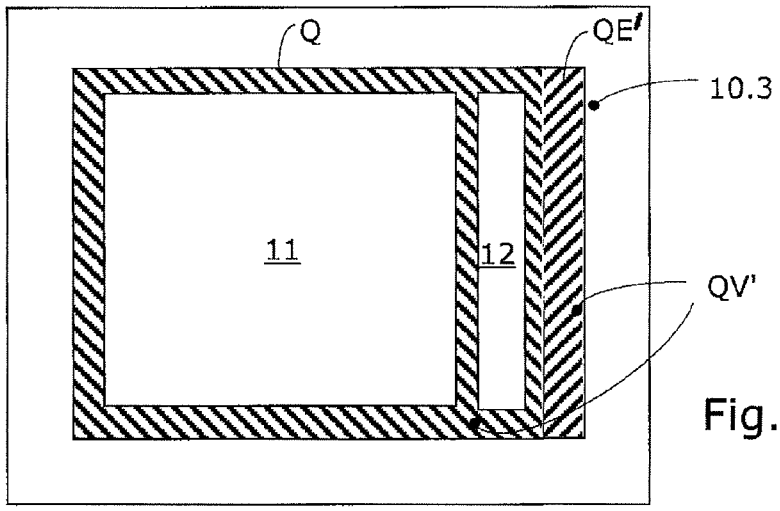
FIG. 3B is a schematic section through an elevator shaft of a second elevator installation according to the present invention.
Figure 3C:
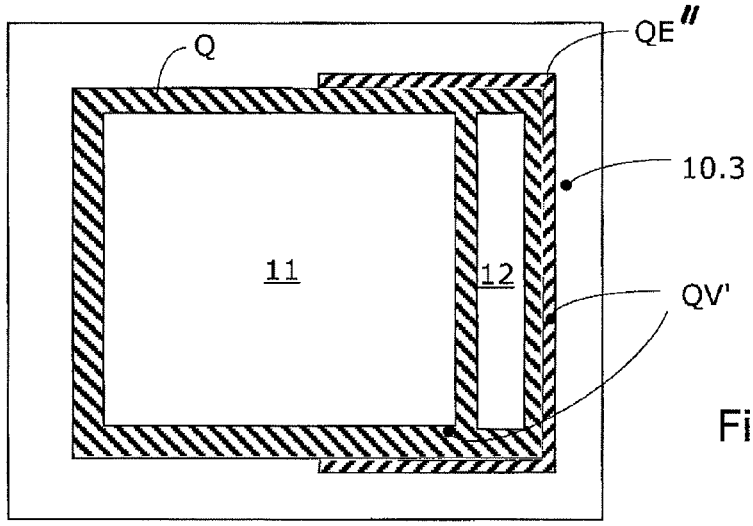
FIG. 3C is a schematic section through an elevator shaft of a third elevator installation according to the present invention.

Different forms of embodiment of the present invention are now shown by way of FIGS. 3A, 3B and 3C. The local cross-sectional increase QE resulting due to the enlargement E provided at the elevator shaft 10 is indicated in these figures by a hatching different from the rest of the shaft cross-section.

FIG. 3A now shows a section C-C in the region of the enlargement E through the elevator shaft 10 shown in FIG. 1. The solution shown in FIGS. 1 and 3A is a first possible form of embodiment of the present invention. In this first form of embodiment the enlargement E is seated at the rearward shaft wall 10.3.

A further form of embodiment, by way of example, of the present invention is shown in FIG. 3B. In the form of embodiment shown in this figure the enlargement E is located at the rearward shaft wall 10.3, extends over the entire width of this rearward shaft wall and has a local cross-sectional increase QE'. This form of embodiment has the advantage that in constructional terms it can be realized more simply than the variant shown in FIG. 3A.

Yet a further form of embodiment, by way of example, of the present invention is shown in FIG. 3C. In the form of embodiment shown in this figure the enlargement E extends not only along the rearward shaft wall 10.3, but also along at least a part of the side walls and has a local cross-sectional increase QE". It is obviously conceivable to extend this enlargement over the entire depth of the side walls.

The effective cross-sectional enlargement (termed QE, QE', QE") is of approximately the same size in all three examples shown in FIGS. 3A, 3B and 3C. However, this dimensioning was only selected so as to be able to make a better comparison of the forms of embodiment with one another. The examples shown in FIGS. 3A to 3C are obviously also usable on arrangements in which the counterweight is arranged laterally. In that case the arrangement of the cross-sectional enlargement QE is advantageously selected in correspondence with the arrangement of the counterweight.

Through this special form of construction of the elevator shaft 10 with a local enlargement E the pressure build-up or pressure shock cannot even build up at the outset or it is at least reduced so substantially that disturbing vibrations or noises no longer arise. Thus, with relative consideration of the car, a cross-section QV' remaining substantially constant over the entire travel path is present.

The enlargement E can be provided in the form of one or more local widenings of the elevator shaft 10, wherein the effective cross-section QW of the elevator shaft 10 is larger in the region of the enlargement E than in the remaining region of the elevator shaft 10. In that case the enlargement E, which locally increases the effective cross-section QW of the elevator shaft 10, can result from a widening within the elevator shaft 10 in that, as shown in FIGS. 1A and 3A, the wall thickness d of a wall of the elevator shaft 10 (for example the rear wall 10.3) or several side walls (see, for example, FIG. 3C) of the elevator shaft 10 is or are reduced in the proximity region A. In this case no additional space of the otherwise building utilization is removed outside the elevator shaft 10. The disadvantage of this variant is that due to the local reduction in the wall thickness d a possible weakening of the building statics arises in the proximity region A of the elevator shaft 10. In addition, disadvantages with respect to acoustic, thermal or fire insulation of the elevator shaft 10 by comparison with the remaining parts of the building can result from a reduced wall thickness of the side walls of the elevator shaft 10.

However, a wall constructed with local thinning can be statically reinforced by constructional measures and fire authority regulations can also be maintained by, for example, application of suitable insulating means.

Another variant for local enlargement of the effective cross-section QW of the elevator shaft 10 is the attachment of a widening to the elevator shaft 10 in the proximity region A. In this variant the wall thickness of the elevator shaft 10 is not reduced in the proximity region A, but an enlargement E is provided in rucksack-manner at a side (or at several sides) of the elevator shaft 10. A disadvantage of this variant is that, however, additional space of the otherwise building utilization is removed.

Accordingly, a combination of the two above-described variants is also conceivable. In that case not only the wall thickness of the elevator shaft 10 is reduced, but also attachment of a widening to the elevator shaft 10 in the proximity region A is provided. The advantages and disadvantages of the two variants can thereby be optimized.

Investigations have shown that the enlargement E considered in terms of cross-section (i.e. QE) should preferably have an extent approximately corresponding with the cross-section QG of the counterweight 12 so as to offer, to the air compressed by the counterweight 12, an escape possibility when the elevator car 11 moves past the counterweight 12. It is thus sufficient to provide a cross-sectional enlargement which is significantly smaller than the cross-section QA of the elevator car 11. This result is of interest and was not previously taken into consideration. If the elevator shaft 10 were to be locally enlarged by the cross-section QA of the elevator car 11, then this would be too large and lead to quite complicated constructional measures and the realization would not be economically feasible.

Calculations and evaluations of experimental tests have given the result that the cross-section QE should preferably correspond with 0.5 to 3 times the cross-section QG of the counterweight 12.

$$0.5*QG<QE<3*QG$$

A cross-section QE in the boundary area of 0.5*QG in this connection requires a very small amount of constructional space in the building and a cross-section QE in the boundary area of 3*QG produces a substantial reduction in the pressure shock.

Forms of embodiment are particularly preferred in which:

$$1*QG<QE<2*QG$$

This design rule makes it possible to achieve good travel comfort with a small space requirement.

In addition, it was ascertained that the length LE of the enlargement E also plays a role. The enlargement E should have, considered in the vertical direction of the elevator shaft 10, a length LE larger than the length LA of the proximity region A. Since the first contact of the built-up pressure in front of the counterweight 12 and the built-up pressure in front of the elevator car 11 occurs before passing of the car 11 and counterweight 12 takes place the dimensioning of the length LE of the enlargement E should preferably proceed from the following formula:

$$1.2\cdot LA \leqq LE \leqq 1.5\cdot LA$$

The same considerations as for the cross-sectional enlargement QE also apply here in analogous manner. A small length extent LE needs less constructional space and a large length extent LE promotes travel comfort. A length LE comprising a 25% addition to the length LA is particularly suitable, i.e.:

$$LE \approx 1.25\cdot LA$$

Advantageously, the length LE can be adapted to the arrangement of building intermediate ceilings so that the length LE extends over a number of floors, for example over two floors. This can be realized in simple manner in the building.

In the stated dimensional examples for the length LE it was also already taken into consideration that the support cables stretch in the course of time. Due to this stretching a slight displacement of the crossing point in the elevator shaft can result. If the length LE were to be selected to be too short, it consequently could be possible after some time for the proximity region to displace, in correspondence with the cable stretching, to outside the enlargement E, whereby pressure shocks would arise again.

The cross-section Q of the elevator shaft 10 should preferably slowly widen in the enlargement region E to the effective cross-section QW. An abrupt enlargement of the effective cross-section QW by an edge can lead to additional pressure shocks or disturbances. Attention should accordingly be given to the enlargement E, considered in cross-section, having a gentle cross-sectional enlargement from the normal shaft cross-section Q to the enlarged cross-section Q+QE in the region of the enlargement E. This transition is readily apparent in FIG. 4. An angle W of the transition of less than 10° is ideal, wherein an angle W of less than 7° has proved particularly advantageous (see FIG. 4).

It has proved that the enlargement of the cross-section QE should be located as close as possible to the point of the cross-section Q of the elevator shaft 10 at which the ram pressure regions of the elevator car 11 and the counterweight 12 impinge on one another.

Figure 4:
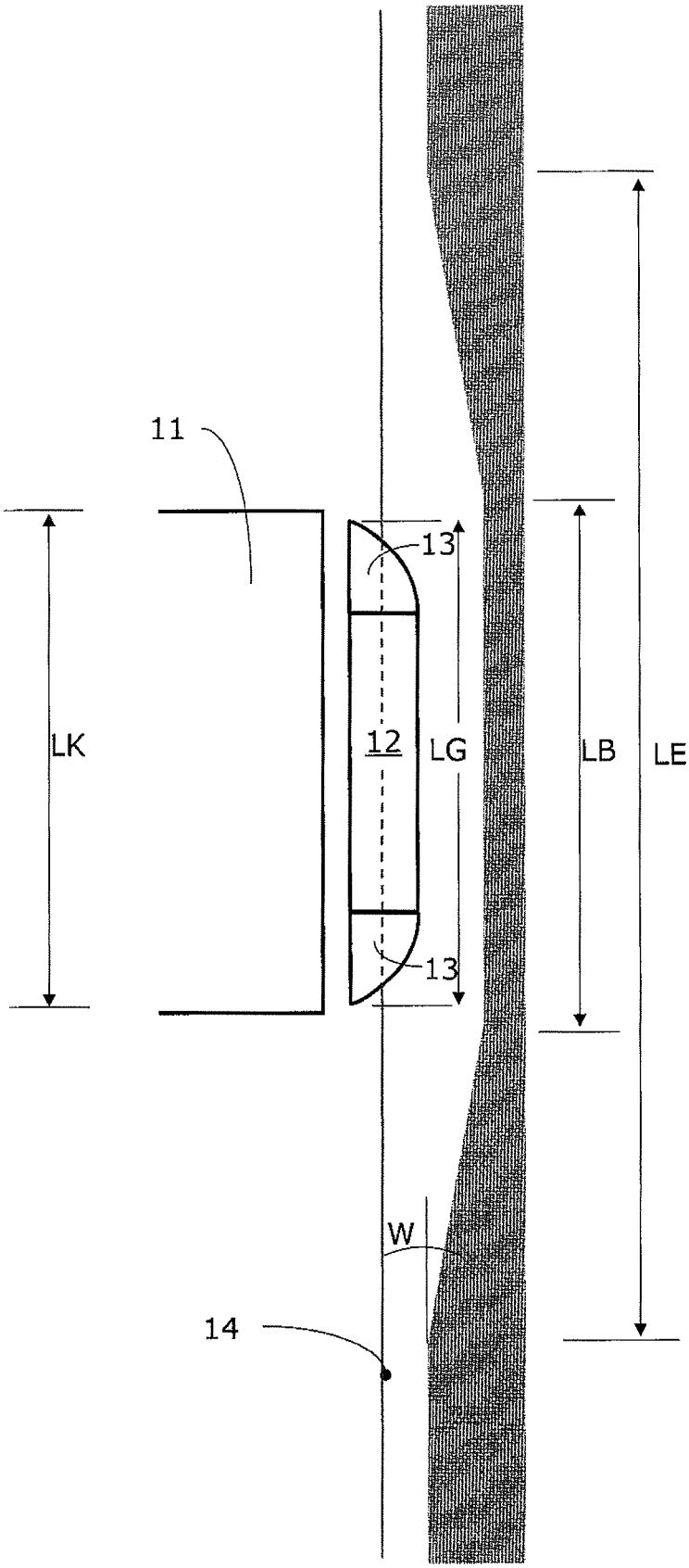
FIG. 4 is a schematic detail of a fourth elevator installation according to the present invention from the side.

The escape behavior of the air masses can additionally be favorably influenced by an aerodynamic cladding 13 of the elevator car 11 and/or the counterweight 12. Thus, for example, the aerodynamic cladding of the counterweight 12, as shown in FIG. 4 can be designed in the manner that the air masses are urged away from the elevator car 10 into the cross-sectional enlargement QE. An aerodynamic cladding of the counterweight 12 additionally has the advantage that the counterweight 12 produces less air resistance in its travel through the elevator shaft 10. Due to the shape of the aerodynamic cladding 13, fewer disturbances arise. When the elevator car 11 and the counterweight 12 pass the air masses are selectively removed into the enlargement region E.

In a currently preferred form of embodiment of the elevator installation of the invention the enlargement E is disposed, considered in the vertical direction of the elevator shaft 10, approximately in the center of the region of the elevator shaft 10 traveled over by the elevator car 11. Meeting of the elevator car 11 and the counterweight 12 occurs in this region.

The invention has proved itself particularly in elevator installations designed as high-speed elevator installations for conveying at speeds of at least 4 m/sec, but use of this invention is also feasible in the case of lower speeds when for the purpose of reduction of the space surrounding the elevator installation the remaining shaft cross-section QV is reduced.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation comprising:

an elevator shaft;

a counterweight and an elevator car, said counterweight and said elevator car being arranged to be movable along vertical rectilinear guide tracks and said elevator car being so connected by way of support means with said counterweight that on movement of said elevator car said counterweight executes an opposite movement and said elevator car moves past said counterweight in a proximity region in said elevator shaft, said elevator shaft having a first predetermined normal shaft cross-section in which said elevator car and said counterweight move along the guide tracks and said proximity region having a second predetermined cross-section adjacent said first predetermined cross-section forming an enlargement of said elevator shaft in order to reduce a pressure shock which builds up in said proximity region when said elevator car moves past said counterweight, wherein neither said elevator car nor said counterweight enters said enlargement during movement along the guide tracks, and wherein said enlargement is bounded by at least one side wall of said elevator shaft and said enlargement does not penetrate said at least one side wall.

2. The elevator installation according to claim 1 wherein said enlargement is at least one local widening of said elevator shaft and a cross-section of said elevator shaft is greater in area at said enlargement than in a remaining region of said elevator shaft.

3. The elevator installation according to claim 1 wherein said enlargement is disposed at a side wall of said elevator shaft adjacent to said counterweight.

4. The elevator installation according to claim 1 wherein said enlargement in a vertical direction of said elevator shaft is disposed approximately in a middle of a region of said elevator shaft travelled in by said elevator car.

5. A method of using the elevator installation according to claim 1 as a high-speed elevator installation for transporting at speeds of at least 4 m/sec.

6. The elevator installation according to claim 2 wherein a cross-sectional area of said enlargement approximately corresponds with a cross-sectional area of said counterweight so as to allow an escape of air, which air is displaced by said counterweight, when said elevator car moves past said counterweight, wherein said cross-sectional area of said enlargement preferably is 0.5 to 3 times said cross-sectional area of said counterweight.

7. The elevator installation according to claim 2 wherein said enlargement has a gentle cross-sectional enlargement from a cross-sectional area of the remaining region of said elevator shaft to said second predetermined cross-section at an angle from vertical of less than approximately 10 degrees.

8. The elevator installation according to claim 2 wherein said enlargement in a vertical direction of said elevator shaft has a length (LE) which is related to a length (LA) of said proximity region according to the formula:

$$1.2 \cdot LA \leqq LE \leqq 1.5 \cdot LA.$$

9. An elevator installation comprising:

an elevator shaft having a normal cross-section of a first predetermined cross-sectional area;

a counterweight;

an elevator car, said counterweight and said elevator car being movable along vertical rectilinear guide tracks in said elevator shaft and said elevator car being connected by support means with said counterweight whereby on movement of said elevator car said counterweight executes an opposite movement, said elevator car and said counterweight moving along the guide tracks and said elevator car moves past said counterweight in a proximity region in said elevator shaft; and an enlargement having a second predetermined cross-sectional adjacent said first predetermined cross-sectional area in said proximity region of said elevator shaft in order to reduce a pressure shock which builds up in said proximity region when said elevator car moves past said counterweight, wherein neither said elevator car nor said counterweight enters said enlargement during movement along the guide tracks, and wherein said enlargement is bounded by at least one side wall of said elevator shaft and said enlargement does not penetrate said at least one side wall.

* * * * *